US006248050B1

(12) United States Patent
Boy

(10) Patent No.: US 6,248,050 B1
(45) Date of Patent: Jun. 19, 2001

(54) METHOD OF MAKING A HANGING FILE FOLDER AND THE FOLDER MADE THEREBY

(75) Inventor: Lee A. Boy, Jamestown, NC (US)

(73) Assignee: Esselte Corporation, Garden City, NY (US)

( * ) Notice: Subject to any disclaimer, the term of this patent is extended or adjusted under 35 U.S.C. 154(b) by 0 days.

(21) Appl. No.: 09/285,973

(22) Filed: Apr. 5, 1999

(51) Int. Cl.[7] ..... B31B 1/84
(52) U.S. Cl. ..... 493/213; 493/947; 383/22
(58) Field of Search ..... 229/67.2; 493/213, 493/212, 374, 379, 380, 947; 382/22

(56) References Cited

U.S. PATENT DOCUMENTS

| | | | | |
|---|---|---|---|---|
| 1,932,419 | | 10/1933 | Newell | 154/26 |
| 3,863,828 | * | 2/1975 | King | 229/67.2 |
| 3,993,522 | | 11/1976 | Ballou | 156/137 |
| 4,177,100 | | 12/1979 | Pennington | 156/157 |
| 4,240,855 | | 12/1980 | Pennington | 156/159 |
| 4,830,268 | * | 5/1989 | Pitts | 493/947 |
| 4,904,319 | | 2/1990 | Divincenzo et al. | 156/73.4 |
| 4,990,296 | | 2/1991 | Pitolaj | 264/162 |
| 5,007,143 | | 4/1991 | Herrington | 24/400 |
| 5,010,627 | | 4/1991 | Herrington et al. | 24/400 |
| 5,063,644 | | 11/1991 | Herrington et al. | 24/400 |
| 5,067,208 | | 11/1991 | Herrington, Jr. et al. | 24/400 |
| 5,070,583 | | 12/1991 | Herrington | 24/400 |
| 5,152,613 | | 10/1992 | Herrington, Jr. | 383/63 |
| 5,161,286 | | 11/1992 | Herrington, Jr. et al. | 24/387 |
| 5,226,734 | * | 7/1993 | Scott et al. | 383/22 |
| 5,261,636 | * | 11/1993 | Hawes, Jr. et al. | 493/947 |
| 5,692,673 | * | 12/1997 | De Safey | 229/67.2 |
| 5,707,001 | | 1/1998 | Mark et al. | 229/67.2 |
| 5,769,772 | * | 7/1998 | Wiley | 493/213 |
| 5,944,423 | * | 8/1999 | Rabin et al. | 229/67.2 |

OTHER PUBLICATIONS

Magnetic Media Hanging Folder Product: a see–through vinyl hanging folder with designated pockets for mag cards, diskettes and hard copies, commercially available from approximately 1982–1984 in 8 styles, including legal size and letter size. Advertising and marketing literature provided, showing all 8 styles. Photocopy is provided of the only Magnetic Media Hanging Folder Product known to still exist. Also included are photographs of this Product showing: front view on a dark background, and front and back views on a light background.

* cited by examiner

*Primary Examiner*—Eugene Kim
(74) *Attorney, Agent, or Firm*—Pennie & Edmonds LLP

(57) ABSTRACT

A method for manufacturing a thermoplastic hanging file folder, and the folder formed by such method. A web of thermoplastic sheet material is provided, where the web has a width with first and second opposed side edge portions. In a separate step, at least one thermoplastic support bar profile extrusion is formed, wherein each support bar profile extrusion comprises a relatively thick upper portion tapering to a correspondingly thinner lower portion. An opposed side edge portion of the thermoplastic web is positioned over the thin portion of the thermoplastic support bar profile extrusion to form a region of contact. In a bonding step, the thermoplastic support bar profile extrusion or extrusions are bonded to corresponding edges of the thermoplastic sheet at the region(s) of contact. A predetermined length of the thermoplastic web, having the thermoplastic support bar profile or profiles bonded thereon, is then separated from a remaining portion of the web to form the hanging file folder.

30 Claims, 3 Drawing Sheets

METHOD OF MAKING A HANGING FILE FOLDER AND THE FOLDER MADE THEREBY

FIELD OF THE INVENTION

The present invention relates to file folders, and in particular, to a method of making a hanging file folder formed of thermoplastic material and to the folder made by such method.

BACKGROUND OF THE INVENTION

File folders, and, in particular, hanging file folders, have long been used in standard storage units such as file cabinets, desk drawers, and the like, and are a necessary storage tool in modern offices and businesses. The typical folder is made of folded cardboard with metal support bars attached to the upper edges. The metal support bars have hooks or notches at their ends to enable the folder to hang on a complementary standard parallel file frame commonly provided in office storage equipment, such as the aforementioned file cabinets and desk drawers.

Such folders often are unable to stand up to the wear and tear to which they are subjected. The cardboard is susceptible to creasing and ripping, particularly where it contacts the support bars and/or along the center fold where the weight of inserted papers is concentrated. In addition, during heavy usage the metal support bars may bend out of shape, so that the folder can no longer be hooked onto the suspension rails. Manufacture of hanging file folders is also less efficient than it could be, due to the number of manufacturing steps needed to produce the cardboard folder and support bars and to attach the components to each other. Furthermore, it is difficult to recycle such a file folder, because of the need to remove the metal support bars from the cardboard prior to disposal.

One way to make a more durable file folder is to manufacture it from thermoplastic material. Thermoplastics such as polypropylene resins have been used in a variety of office products such as pocket folders and non-hanging file folders, which have advantages over cardboard folders such as durability and shape-retention. Thermoplastic folders are also easy to recycle.

In the manufacture of a hanging thermoplastic file folder, a thin thermoplastic sheet may be formed and folded to define a folder, and support bars, also formed of thermoplastic, may be positioned along the upper edges of the folder to add strength and rigidity, and to enable the folder to hang from suspension rails. One concern in forming such a folder is the method by which the relatively thick support bars are attached to the comparatively thin, upper edges of the folder. The desired result is a smooth, flat file folder with straight, fairly rigid bars along the upper edges. However, known methods for connecting a thick bar of plastic to a thin sheet of similar or like material often achieve less-than-satisfactory results.

Attaching or welding a thin sheet of plastic to a thick bar or strip is a technique practiced in a variety of technological fields. One such field involves the formation of plastic bags with zipper closures. U.S. Pat. No. 5,152,613 to Herrington (hereinafter "the '613 patent") discloses a "plastic film zipper bag having straightened heat seals", wherein a thin film of plastic is extruded and plastic zipper "fins" or elements are extruded in a separate operation. The plastic film, which forms the bag portion, is thereafter attached at its upper edges to the plastic fins of the zipper track. The plastic fins are thicker in cross-section than the thin film edges.

Thus, when these components are heated and melted together, the thin film edges heat and melt more quickly than the fins, which act as a heat sink due to their much greater thickness. The unequal heating and melting of these components tend to cause the fin and film to shrink and pucker after they have been welded together and begin to cool down. The result is puckering and bending along the weld line. The '613 patent addresses this phenomenon by disclosing a method of stretching the seal line.

While welding together separate components with unequal cross-sections can lead to inadequate welds, certain other processes avoid such weld problems by forming the thick and thin sections together, i.e., as one piece. For example, in a process known as profile extrusion, the profile, or cross-section, of the part to be extruded contains both thick and thin sections. Typically, however, a profile design that contains both thick and thin sections is to be avoided, because the thicker section cools more slowly than the thin part of the profile upon exiting the profile extrusion die. As the profile cools, it shrinks somewhat. The relatively quick cooling and shrinking of the thin section, coupled with the slower cooling and shrinking of the thick section, can result in a profile whose shape is warped or distorted.

Also known in the prior art is a hanging, disk-storage pocket sold by the Esselte Corporation from 1983 to 1985. The disk-storage pocket was for storing 5.25-inch and 3.5-inch computer disks, and the transparent, PVC pocket could be hung on a support frame. The pocket has a single support bar that is high-frequency welded to a back upper edge of the pocket, and the front upper edge of the pocket is cut in a wide V shape to facilitate access to the inside of the pocket. To manufacture the disk-storage pocket, the support bar is extruded as a relatively stiff profile extrusion which is cut into individual support bars, and notches are cut into the bars near their terminal ends to enable the completed pocket to hang on a support frame. In a separate process, flat sheets of PVC are cut into appropriate shapes for the front and back walls of the pocket body. To assemble the pocket, a first flat sheet that is to form the back wall is aligned so that its upper edge overlaps an edge portion of the support bar. A second flat sheet, pre-cut to the shape of the pocket's front wall, is positioned on top of the first flat sheet. The first and second flat sheets are welded to each other at their side and bottom edges in order to form the pocket body, and the top edge of the first flat sheet is welded to the support bar to complete the pocket assembly.

The manufacturing process for making the disk-storage pocket thus requires a number of discrete steps, all of which add to the expense of producing the item. Furthermore, the completed pocket has exposed seam edges where the overlapping support bar and back wall edges are welded together. These exposed seam edges are capable of snagging computer disks or other items that are inserted into or pulled out of the pocket, and they create stress concentrations in the adjacent portions of the pocket walls when the pocket is pulled, twisted or bent. Such stress concentrations can lead to premature tearing, which is unsightly and shortens the useful life of the pocket.

In manufacturing a thermoplastic hanging file folder, which is to have thick support bars attached to the top edges of a thin, folded sheet, none of the processes described thus far optimizes the connection between the thin sheet and the thick bar. As described above, extruding thin and thick components separately and then welding them together causes a weld line that tends to pucker or bend. Furthermore, extruding thick and thin components together in a single piece or profile tends to cause warping or distortion. Such an extrusion design is also particularly problematic in the manufacture of hanging file folders, because the extruded thermoplastic webbing used in forming the folder body passes between and around rollers at different stations in the machinery of the extrusion line. If the support bar were extruded together with the webbing, the thickness of the support bars would interfere with the rollers that guide and pull the sheet or web of thermoplastic through the machinery. Also described above is the process of welding together the edges of a relatively stiff bar and a comparatively bendable flat sheet of thermoplastic, with the result that exposed seams edges may cause snagging or tearing. In manufacturing processes that require the fabrication, cutting, alignment and welding of a number of separate pieces of thermoplastic material, the inefficiencies built into such processes increase the costs of the final product.

Thus, a need exists for a method of making a hanging file folder that is more durable than the typical paper folder known in the art; that can be made of thermoplastic, wherein the manufacturing process does not lead to puckering, warping, distortion, snagging or tearing at the connection between the support bars and the upper edges of the folder; and wherein the number of manufacturing steps is minimized so as to produce an inexpensive, strong, recyclable folder having support bars that are securely and smoothly attached to the folder edges.

SUMMARY OF THE INVENTION

The present invention is directed to a method of making a hanging file folder and to the file folder made thereby. According to a first, i.e., "continuous" embodiment of the method of the invention, in a first step a web or sheet of thermoplastic having first and second opposed side edges is formed. These edges thereafter become the upper edges of the file folder. In a second, separate step, at least one and preferably two thermoplastic support bar profile extrusions are formed in a profile extrusion process. The support bar profile extrusions, which are cut and attached to the web as explained below to form the folder support bars, are each produced in the shape of a long, continuous strand having a uniform cross-section. In the extrusion art, the extrusion shape is known as a "profile".

Preferably, the thermoplastic web or sheet and the support bar profile extrusions are formed from a polymeric material, of which the most preferred material is polypropylene. The support bar profile extrusions may if desired be made of polypropylene that is filled with a reinforcing agent to enhance stiffness and strength.

Each support bar profile extrusion has a relatively thick upper portion which is more or less rectangular in cross-section and which may include a plurality of ribs for improved strength and rigidity. The thick upper portion then narrows down to a correspondingly thinner lower portion. The lower portion is defined on its inner face by a tapered surface configured and adapted to form a smooth transitional surface at the interface between the support bar profile and the thermoplastic sheet to prevent bending and/or snagging of papers as they are placed into or removed from the folder. The other side of the lower portion will face the outside of the folder and is defined by a thin strip extending downwardly from the outer face of the upper portion, having a cross-sectional thickness approximately the same as the thickness of the thermoplastic sheet. In this context, words denoting the directions "up" and "down" refer to the orientation of components of the folder when it is hanging by its support bars in a file frame. Also, as used herein an "inner face" is on the inside of the folder, while an "outer face" faces the outside of the folder.

In the next stage of file folder formation the web of thermoplastic sheet is guided so that at least one and preferably both its first and second opposed side edges are laid over the corresponding thinner lower portions of the first and second thermoplastic support bar profile extrusions. A first region of contact is formed between the first side edge of the thermoplastic sheet and the thinner lower portion of the first support bar profile extrusion, and a second region of contact is formed between the second side edge of the thermoplastic sheet and the thinner lower portion of the second support bar profile extrusion. At the first and second regions of contact, the thermoplastic support bar profile extrusions are bonded to the opposed side edges of the thermoplastic sheet, preferably by heat bonding, but alternately other bonding methods known in the art may be substituted.

For some applications, as noted above, it may be desirable to attach only one thermoplastic support bar profile along one corresponding web edge. In such a case, the opposite side portion of the folder, i.e., without a support bar, may be supported, e.g., by folding it upwardly toward the supported portion and bonding the two portions together along their lateral edges using, for example, an adhesive, heat bonding or other methods well known in the art.

After bonding is completed, the resultant composite is separated into desired lengths, each of which comprises, in the preferred embodiment, a folder body having two side edges and a width and two support bars attached to the two upper edges of the folder body. During the separation step, the web portion is cut such that the support bar(s) have terminal end portions that extend past the side edges of the web. The folder body may thereafter be scored at one or more fold lines across its width to produce a hanging file folder having two sides and two walls with upper edges that are attached to the support bars.

According to an alternate, i.e., "batch" method of the process of the invention, the thermoplastic web or sheet is formed and then cut to create an open file folder body having first and second upper edges and a width. Correspondingly, two thermoplastic support bar profile extrusions are separately formed, wherein each profile extrusion has, as described above, a cross section comprising a thick portion, a tapered portion and a thin edge portion. The support bar profile extrusions are independently cut into support bars that fit the upper edges of an open file folder body. The open file folder body is positioned such that its first and second upper edges overlap the thin edge portions of the first and second support bars so as to form a region of contact between each upper edge of the open file folder body and the thin edge portion of a support bar. The first and second upper edges of the open file folder body are then bonded to the support bars at each region of contact. To create at least one fold line, the open folder body may be scored across its width. When folded at the fold line, the hanging file folder has two sides and two walls having upper edges that are attached to the support bars.

As with the continuous process described above, moreover, in an alternative embodiment of the invention only one support bar is attached to one upper edge portion of the file folder body whereupon the walls of the folder are either connected at the sides or are otherwise configured to keep the folder walls in a more or less vertical orientation.

In either the continuous or the batch embodiment of the invention, notches may be cut into the support bars near their terminal ends to make if easier for the completed file folder to hang on a file frame.

A further embodiment of the method of the invention includes the step of forming the support bar profile with a slot in the lower portion of the profile. The slot extends upward, toward the upper portion.

Additionally, a printing step may be included so that the completed file folder has a message or logo printed thereon.

In a further embodiment, the invention is a hanging file folder comprised of a file folder body and, preferably, two support bars wherein each support bar has a relatively thick upper portion that tapers down to a lower edge having a thin strip. For convenience the portion of the support bar that tapers down to the lower edge is referred to herein as the tapered portion. A slot in the lower portion extends upward into the tapered portion toward the thicker upper portion. The file folder body has two upper edge portions. These upper edge portions are each inserted into the slot in the lower portion of a support bar, creating a region of contact where each upper edge overlaps the thin strip of a support bar. The upper edge portions of the file folder body are bonded to the thin strips of the support bars.

The above and other features and advantages of this invention and the manner of attaining them will become more apparent, and the invention itself will best be understood, from a study of the following description with reference to the attached drawings.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
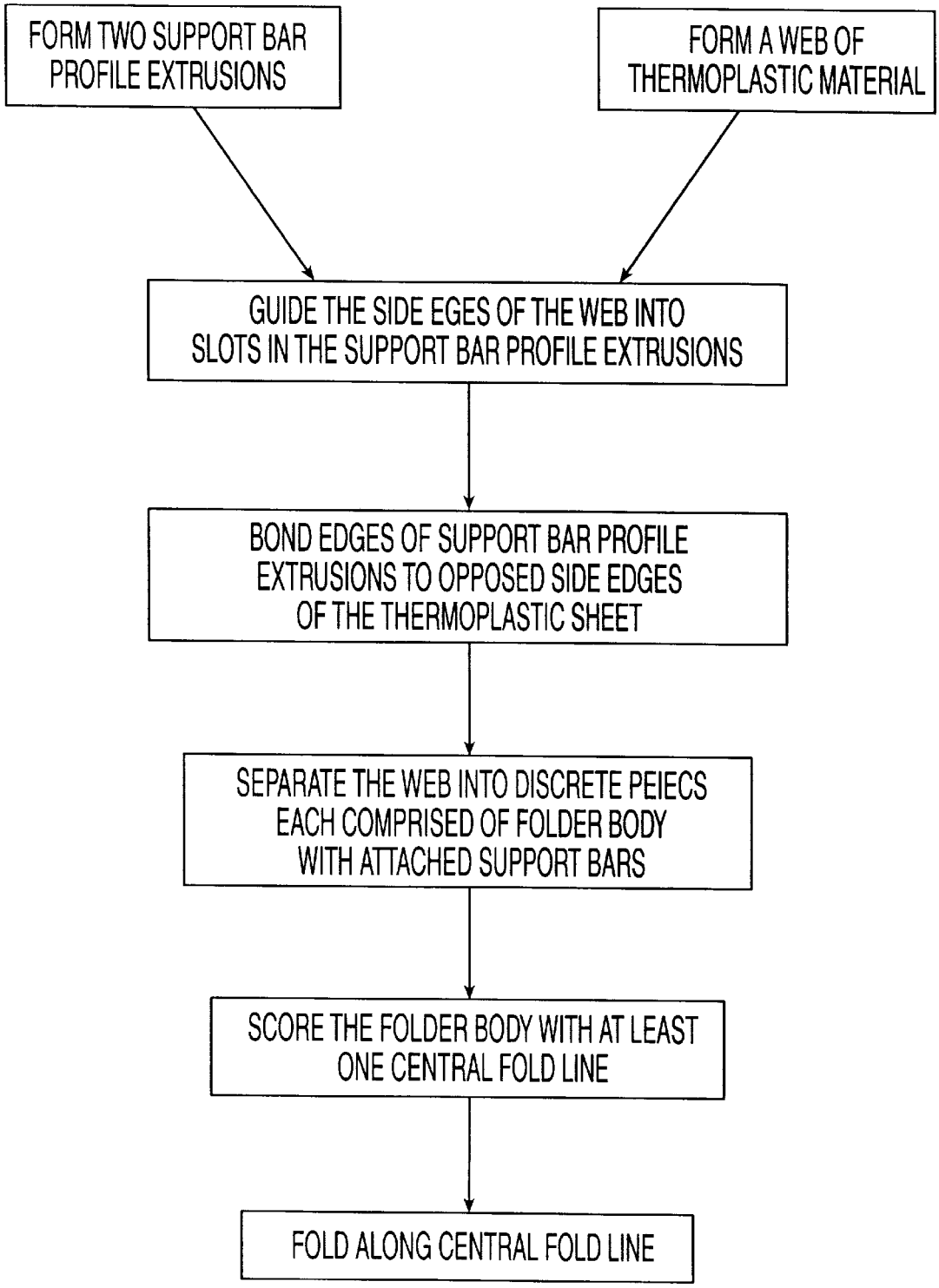
FIG. 1 is a schematic block diagram setting forth a preferred embodiment of the method steps of the invention.

FIG. 1 is a schematic block diagram of a preferred method of making a file folder according to the present invention. A first extrusion line produces two support bar profile extrusions that will be formed into support bars. A profile extrusion is a term used in the extrusion art to denote the product of a profile extrusion process, i.e., a continuous length of extruded material having a uniform cross section, or profile. A second extrusion line produces a sheet extrusion that will be formed into file folder bodies. The sheet extrusion is in the form of a web, which is a large, continuous roll of material having two opposed side edges.

The support bar profile extrusions and the sheet extrusion disclosed herein are preferably formed from a thermoplastic polymer such as polypropylene, ABS or nylon. Polypropylene is the most preferred material for the extrusion that will form the file folder body although other methods known in the art may be substituted if desired. To ensure that the folder's support bars have appropriate stiffness and strength to withstand heavy use, it is desirable to use polypropylene filled with glass or other reinforcing agents known in the art for forming the support bar profile extrusions.

Once formed, the thermoplastic web is rolled and cooled. Then it is unwound and combined with two support bar profile extrusions in a bonding operation. In the bonding operation, the opposed side edges of the thermoplastic sheet extrusion are guided so that they are aligned with and overlap the thin lower portions of the support bar profile extrusions. In the preferred embodiment the region of overlap is heated until the thermoplastic polymer melts, thus welding together the sheet edges and support bar edges. Because the thin portion or strip of the support bar is of similar thickness to the sheet edge, the two materials heat up at approximately the same rate and form a smooth, flat, strong bond wherein puckering is minimized and preferably is completely prevented.

Heating of the overlapping edges may be accomplished by using infrared heat; a hot air gun; heated bars, irons or contact rollers; or other means, known to those of ordinary skill in the art, that induce heat through the double thickness of the sheet edge and the support bar profile edge.

Once the overlapping edges are heated and thereby welded together, the heat-welded extrusion is then cut and scored at a cutting and scoring station, after the weld has cooled, into individual pieces that are shaped like opened file folders. Preferably the pieces are die-cut. At the cutting and scoring station, the folder body is also scored across its width to create at least one central horizontal fold line.

When cutting the heat-welded extrusion into individual folders, it is preferably cut so that the support bars extend past the side edges of the folder. Therefore, some of the thin thermoplastic web material is cut away and forms scrap. This scrap may be collected and conveyed back to an extruder for re-melting and reprocessing. Notches are also cut near the ends of the support bars to enable the file to hang on a file frame located in a drawer, cabinet, etc. Scoring is preferably accomplished by using a scoring roller with a rounded knife edge on one face of the thermoplastic web and an opposing roller with a groove in it, on the opposite face of the web, but alternative means known in the art may be employed to put one or more fold lines on the folder body. Additionally, the scoring station does not have to be combined with the cutting station, but may instead be located before or after the cutting step.

An optional printing step may also be included in the process of the invention to imprint words or marks on the folder through either a hot-stamp process or a cold embossing step. The printing step may occur before or after cutting and scoring, or the three operations may be combined at one station.

Optionally, instead of forming two support bar profile extrusions, the method of the invention may comprise the formation of only one support bar profile extrusion, which is bonded to one of the two opposed side edges of the thermoplastic sheet extrusion. A hanging file folder made therefrom would have one support bar that is bonded to one upper edge of the file folder body. The front and back walls of the file folder body may be connected at the sides, or other methods known in the art may be employed to keep the walls in a substantially vertical orientation when the folder is hanging in a hanging file folder frame.

The method described above and illustrated schematically in FIG. 1 is preferably a continuous, or in-line, operation. An alternative embodiment to the continuous method is the off-line finishing or off-line batch welding method, which involves cutting the thermoplastic web and the support bar profile extrusions to size before welding the support bars to the web edges. In the off-line finishing embodiment, the sheet extrusion line produces the thermoplastic web, which is then cut into file folder bodies of an appropriate length. The profile extrusion line produces one or more support bar profile extrusions, which are then cut into bars with notches near each end. The folder bodies and support bars are then combined and fused together either in assembly line fashion, or on a turntable with multiple stations. The folders are scored and also may be imprinted, as described above for the continuous embodiment.

In one embodiment of either the continuous or batch method of making the hanging file folder, a step may be added wherein the support bar profile is formed with a slot in the thinner lower portion. The slot extends upward towards the thicker upper portion and provides for smooth, accurate positioning when the upper edge of the file folder body is laid over the thinner lower portion of the support bar or support bar profile.

Figure 2:
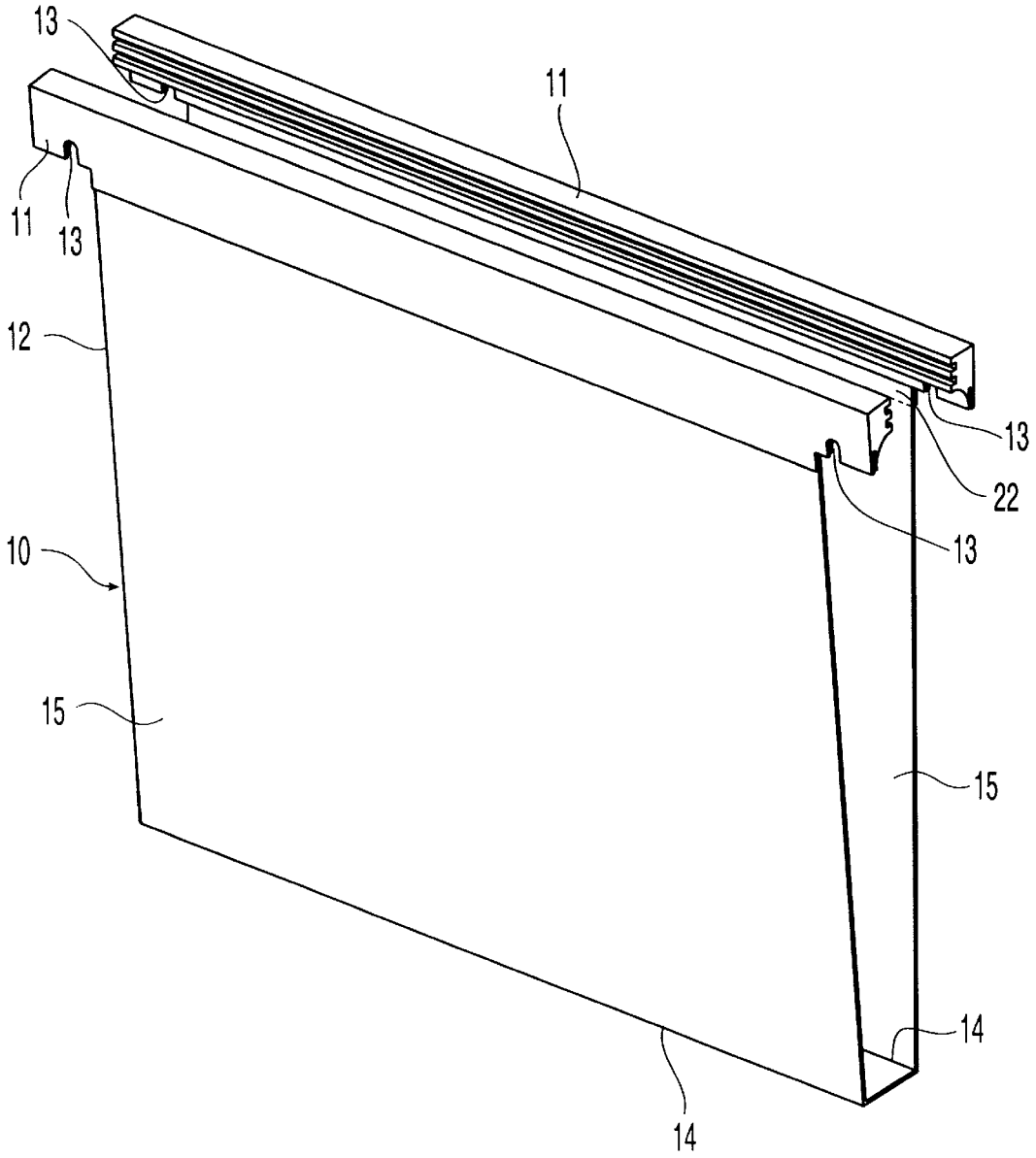
FIG. 2 is a perspective view of the completed folder assembly.

The completed file folder assembly 10, illustrated in FIG. 2, features support bars 11 whose ends extend past the width of the file folder body 12. Notches 13 are formed near each end of support bar 11. The notches 13 are spaced so that they may be supported by a conventional rack or frame commonly available for suspending file folders. Although the illustration in FIG. 2 features two folds 14 for a folder that can accommodate thick files, the number of folds is not critical. Folder walls 15 extend upward from the folds.

Figure 3:
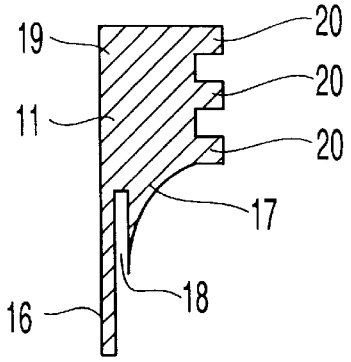
FIG. 3 is a cross-sectional view illustrating the preferred profile of the suspension portion of the folder.

FIG. 3 illustrates support bar profile extrusion 11 for the hanging file folder of the invention, wherein the bar 11 has a thin strip 16 along the other face of its bottom edge, a tapered inner face 17, a slot 18 that is defined on one side by the strip 16 and on the other by the tapered face 17, and a relatively thick portion 19 that has optional ribs 20 for strength and rigidity. Ribs 20 also enable tabs (not shown) to be hooked or otherwise secured to the top portion of the support bar for indexing purposes.

Figure 4:
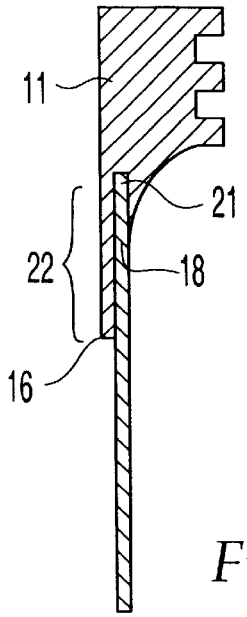
FIG. 4 is a cross-sectional view illustrating the attachment between the thermoplastic web and the suspension portion of the folder.

FIG. 4 illustrates a cross-section of support bar 11 with the upper edge 21 of a file folder wall 15 inserted into slot 18 and welded in place. Slot 18 enables the upper edge 21 to be banked so that accurate assembly is facilitated and so that edge 21 is hidden from view, resulting in a clean appearance and a reduced likelihood that the folder edge will catch or snag things or peel away from the support bar.

Support bar 11 and upper edge 21 of the file folder wall are bonded in region of contact 22 where thin strip 16 and upper edge 21 overlap. As described previously, an improved bond results when the two pieces to be welded together are of like or similar thickness. This improved bond is smooth, flat, strong and snag-resistant, and a folder made with such a bond has improved capability to withstand impact, bending, fraying, tearing and other forces and stresses to which hanging file folders are likely to be subjected.

Figure 5:
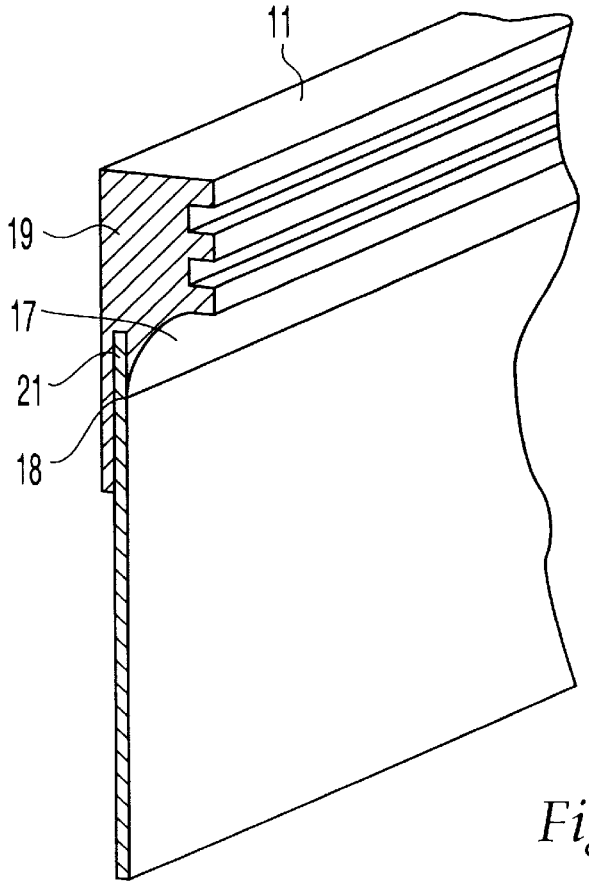
FIG. 5 is a partial cut-away view of the inside of the folder including the suspension portion.

FIG. 5 is a cut-away view of support bar 11 and the inside face 23 of file folder wall 15 with its upper edge 21 inserted into slot 18. The double thickness at region of contact 22 extends across the width of the folder wall 15, as illustrated on FIG. 2 at region of contact 22 above the dotted line. The double thickness gives the folder additional strength in a region that tends to experience high stress. In addition, FIG. 5 illustrates how the insertion of upper edge 21 into slot 18 hides the upper edge from view and allows tapered section 17 to form a smooth transition from the thick portion 19 of support bar 11 to the inside face 23 of the folder wall 15. This smooth transition helps to keep the edges of papers from being snagged as they are put into and removed from the file folder.

It should be understood that variations and modifications within the spirit and scope of the invention, beyond those discussed herein, may occur to those skilled in the art to which the invention pertains. Accordingly, all expedient modifications readily attainable by one versed in the art from the disclosure set forth herein are to be included as further embodiments of the present invention. The scope of the present invention accordingly is to be defined as set forth in the appended claims.

What is claimed is:

1. A method for manufacturing a hanging file folder, comprising the steps of:

providing a web of thermoplastic material having a width with first and second opposed side edge portions;

providing at least one thermoplastic support bar profile extrusion having a thicker upper portion which tapers to a thinner lower web-contacting portion having a thickness which is about the same as that of the web of thermoplastic material;

providing the at least one thermoplastic support bar profile with a slot in the lower portion extending toward the upper portion;

guiding a side edge portion of the web over the thinner lower portion of the thermoplastic support bar profile extrusion and into the slot of said thermoplastic support bar profile extrusion such that a region of contact is formed between the edge portion of the web and the thinner lower portion of the thermoplastic support bar profile extrusion;

heat bonding the lower portion of the thermoplastic support bar profile extrusion to a corresponding edge of the web at said region of contact, wherein said lower portion and said thermoplastic web are heated at approximately the same rate to form a smooth, flat bond, thereby minimizing puckering; and separating a predetermined length of the web having the at least one thermoplastic support bar profile bonded thereon from a remaining portion of said web to form said hanging file folder.

2. The method of claim 1, wherein the lower portion of the thermoplastic support bar profile extrusion provides a flat surface in said region of contact with the web, and further comprising bonding the entire flat surface on the lower portion of the thermoplastic support bar profile extrusion to the web at said region of contact.

3. The method of claim 1, comprising:

providing first and second thermoplastic support bar profile extrusions;

laying the first and second opposed side edge portions of the thermoplastic web over the lower portions of the first and second thermoplastic support bar profile extrusions to produce first and second regions of contact between the respective edge portions and the lower portions of the support bar profile extrusions; and heat bonding the lower portions of said first and second support bar profile extrusions to said first and second opposed edge portions at said respective regions of contact.

4. The method of claim 1, wherein the lower portion of said thermoplastic support bar profile extrusion comprises, on an inner face, a tapered surface, and on an outer face a thin strip extending downwardly from the upper portion.

5. The method of claim 1, further comprising:

scoring at least one fold line across the width of the thermoplastic web; and folding the file folder along said fold line.

6. The method of claim 3, wherein the thermoplastic support bar profile extrusions are heat welded to the first and second opposed side edges of the thermoplastic web at the respective first and second regions of contact.

7. The method of claim 1, wherein said predetermined length of thermoplastic web is die-cut from a web of extruded thermoplastic.

8. The method of claim 1, which further comprises providing at least one rib in each said thermoplastic support bar profile extrusion to enhance the strength and rigidity of each said thermoplastic support bar.

9. The method of claim 1, which further comprises forming a notch adjacent a first and a second end of each said support bar, each said notch configured and adapted for supporting said folder upon a file frame.

10. The method of claim 1, which further comprises forming said thermoplastic web and the thermoplastic support bar profiles out of polypropylene.

11. The method of claim 1, which further comprises forming the thermoplastic support bar profiles from polypropylene filled with a reinforcing agent.

12. The method of claim 1, which further comprises providing a printed message on an outer surface of the hanging file folder.

13. The method of claim 1, further comprising:

providing a further thermoplastic support bar profile extrusion having a thicker upper portion which tapers to a thinner lower portion;

providing the further thermoplastic support bar profile with a slot in the lower portion extending toward the upper portion;

guiding a further side edge portion of the web over the thinner lower portion of the further thermoplastic support bar profile extrusion and into the slot of said further thermoplastic support bar profile extrusion such that a region of contact is formed between the further edge portion of the web and the thinner lower portion of the further thermoplastic support bar profile extrusion; and heat bonding the lower portion of the further thermoplastic support bar profile extrusion to the further edge portion of the web at said region of contact, wherein said lower portion and said thermoplastic web are heated at approximately the same rate to form a smooth, flat bond, thereby minimizing puckering.

14. The method of claim 13, wherein the lower portion of each thermoplastic support bar profile extrusion comprises a tapered surface on an inner face, and further comprising scoring at least one fold line across the width of the thermoplastic web and folding the file folder along said fold line.

15. The method of claim 14, wherein the thermoplastic support bar profile extrusions are heat welded to the side edges of the thermoplastic web at the respective regions of contact.

16. The method of claim 13, which further comprises providing one or a plurality of ribs in each thermoplastic support bar.

17. The method of claim 13, which further comprises forming a notch near a first and a second terminal end of said support bars, said notches configured and adapted for supporting said folder upon a file frame.

18. The method of claim 13, which further comprises forming the thermoplastic sheet and the thermoplastic support bar profile extrusions out of polypropylene.

19. The method of claim 13, which further comprises using polypropylene filled with a reinforcing agent to form the thermoplastic support bar profile extrusions.

20. The method of claim 13, which further comprises imprinting a printed message on the hanging file folder.

21. The method of claim 1, wherein the lower portion of said thermoplastic support bar profile extrusion comprises, on an inner face, a tapered surface such that when the web is attached to the support bar the inside forms a smooth transition with no edges which may snag a paper that is placed into or removed from the file folder.

22. The method of claim 1, wherein the lower portion of at least one of said thermoplastic support bar profiles comprises, on an inner face, a tapered surface such that when the web is attached to the support bar the inside forms a smooth transition with no edges which may snag a paper that is placed into or removed from the file folder.

23. A method for manufacturing a hanging file folder, comprising the steps of:

forming a web of thermoplastic sheet material;

cutting the thermoplastic web to form a file folder body having first and second upper edges and a width;

providing first and second thermoplastic support bar profile having first and second support bars, each of which has two terminal ends, a thicker upper support portion, and a thinner lower web-contacting portion defined on one side, by a tapered surface on an inner face of said lower portion and, on the other side, by a strip having a thickness which is about the same as that of the web of thermoplastic material extending downwardly from an outer face of the upper portion with a slot formed between the tapered surface and strip;

positioning the file folder body such that its first upper edge engages the slot and overlaps the lower portion of the first support bar so as to form a first region of contact between the first edge of the open file folder body and the strip of the first support bar;

positioning the file folder body such that its second upper edge engages the slot and overlaps the lower portion of the second support bar so as to form a second region of contact between the second edge of the open file folder body and the strip of the second support bar;

heat bonding the first and second support bars to the first and second upper edges of the file folder body at, respectively, the first and second regions of contact, wherein said lower portion and said thermoplastic web are heated at approximately the same rate to form a smooth, flat bond, thereby minimizing puckering; and scoring at least one fold line that extends across the width of the file folder body and folding the file folder body along said fold line, so that the hanging file folder has two sides and two walls having upper edges that are attached to the support bars.

24. The method of claim 23, wherein the first region of contact is between the first edge of the open file folder body and a surface on the strip of the first support bar, and wherein the second region of contact is between the second edge of the open file folder body and a surface on the strip of the second support bar.

25. The method of claim 23, which further comprises heat-welding the first and second thermoplastic support bars to the first and second upper edges of the open file folder body at the first and second regions of contact.

26. The method of claim 23, which further comprises providing a plurality of ribs in each thermoplastic support bar.

27. The method of claim 23, which further comprises forming a notch near a first and a second terminal end of said support bars, said notches configured and adapted for supporting said folder upon a file frame.

28. The method of claim 23, which further comprises forming the thermoplastic sheet and the thermoplastic support bar profile extrusions out of polypropylene.

29. The method of claim 23, which further comprises using polypropylene filled with a reinforcing agent to form the thermoplastic support bar profile extrusions.

30. The method of claim 23, which further comprises imprinting a printed message on the hanging file folder.

* * * * *